US005357554A

United States Patent [19]

Schneiderman et al.

[11] Patent Number: 5,357,554

[45] Date of Patent: Oct. 18, 1994

[54] APPARATUS AND METHOD FOR REDUCING X-RAY GRID LINE ARTIFACTS

[75] Inventors: Gerald S. Schneiderman, Waukesha; Daniel R. Unger, Milwaukee, both of Wis.

[73] Assignee: General Electric Company, Milwaukee, Wis.

[21] Appl. No.: 129,970

[22] Filed: Sep. 30, 1993

[51] Int. Cl.[5] ..... G21K 1/00

[52] U.S. Cl. ..... 378/155; 378/154

[58] Field of Search ..... 378/154, 155

[56] References Cited

U.S. PATENT DOCUMENTS 4,970,398 11/1990 Scheid ..... 250/374

5,040,202 8/1991 Scheid ..... 378/155

5,212,719 5/1993 Verta et al. ..... 378/155

*Primary Examiner*—Craig E. Church

*Attorney, Agent, or Firm*—Quarles & Brady

[57] ABSTRACT

A X-ray imaging system has a moveable grid which rejects X-rays that were scattered by a body being imaged. During an X-ray exposure the grid is reciprocated to blur the shadow of the grid in the image. Upon commencement of an X-ray exposure, the grid is moved at decreasing rate in a first direction toward an end point of travel. When the grid is near the end point, the movement rate increases and continues at this faster rate before and after the grid reverses direction at the end point. A given distance after the direction reversal, the rate decreases to a slow constant rate.

13 Claims, 5 Drawing Sheets

APPARATUS AND METHOD FOR REDUCING X-RAY GRID LINE ARTIFACTS

BACKGROUND OF THE INVENTION

The present application relates to X-ray imaging systems; and more particularly to such systems having grids to reject scattered radiation.

An apparatus for creating X-ray radiographs is comprised generally of an X-ray source and an X-ray sensitive medium, such as a photographic film and screen combination, for recording an image produced by the varying transmission of X-rays directed through an imaged body. The intensity of a radiographic image at a given point on its surface is ideally a function of the absorptive characteristics of the image body along a straight line from the X-ray tube to that point on the image. For this relationship to hold, X-rays that have not traveled in a straight line from the X-ray tube to the medium, i.e. those that have been scattered within the body, must be blocked to prevent their contribution to the recorded image.

Shielding the medium from scattered X-rays typically is done with a grid that is placed immediately above the medium, such as shown in U.S. Patent No. 5,040,202. The grid contains channels that are oriented to pass only X-rays proceeding in straight lines from the X-ray tube. These channels are formed by rows of parallel vanes that are constructed of X-ray absorptive material. The vanes are separated either by low obsorptivity solid, such as plastic, or in certain instances by air gaps.

The physical thickness of the grid vanes, as measured along the plane of the X-ray sensitive medium, cause some of the X-rays that would otherwise be passed by the grid to be blocked. The blocking of these X-rays produces shadow "grid lines" in the image. Even fine grid lines may be distracting and larger grid lines can obscure diagnostically significant details in the image. One method of reducing grid lines is to move the grid back and forth parallel to the plane of the X-ray sensitive medium using a DC motor with a cam shaft connected to the grid. The grid shadow thus is blurred by falling on different areas of the medium during the exposure. If the grid can be moved so that each area of the medium is eclipsed by the vane for an equal proportion of the exposure time, the grid lines effectively will be eliminated.

In general, it is quite difficult to move the grid so that its vanes spend an equal amount of time over each area of the mediums. Reciprocating the grid at a constant speed with respect to the medium is one approach. The constant approach speed is upset when the grid changes direction and must be decelerated and then reaccelerated in the opposite direction. In previous reciprocating systems, the grid lines spent a disproportionate amount of dwell time near the ends of their travel, as compared with the center of the travel. As a result, faint grid lines appeared under each vane at the vane's point of direction reversal.

Different techniques have been utilized to reduce the grid line shadows at the end of their reciprocating movement. For example, the aforementioned U.S. Patent describes modulating the X-ray beam synchronously with the grid motion to reduce the grid image at points of grid speed variation. Although this technique was successful, it required additional components of the circuitry for regulating the X-ray beam and a mechanism by which the modulation of the beam was synchronized with the movement of the grid.

SUMMARY OF THE INVENTION

An object of the present invention is to move the radiographic grid in a reciprocal manner to blur shadows of the grid lines on the image even for exposures during which end of travel points are reached and the direction of grid movement reverses.

In order to achieve the desired objective the speed of the grid must be increased in a controlled manner at the end of the grid travel. For that purpose, a stepper motor is attached to move the grid in steps of a fixed incremental distance with the grid plane movement parallel to the plane of the X-ray medium on which an image is produced. A controller regulates the speed and direction of the motor and thus the grid to produce the following pattern of movement.

Preferably before an X-ray exposure commences the grid is moved to one end of its travel so that the initial movement during the exposure will not be against the force of gravity. Upon commencement of an X-ray exposure, the grid is moved at a first rate in a direction toward the other end of the travel and thereafter the rate of movement periodically decreases.

As the grid nears the other end point, the rate of movement increases, for example the rate doubles. When the grid reaches the other end point, the direction of movement reverses so that the grid then travels toward the opposite end point. In the preferred embodiment of the present invention, the rate of movement increases to an even higher rate for a period of time immediately after the direction reversal. Then the rate of grid movement reduces to about the second rate for a given distance before slowing again to a constant speed. If the X-ray exposure is long enough the grid reverses direction in a similar manner when it reaches either end point.

By increasing the rate at which the grid moves just before and after the point where the direction of movement is reversed, the grid shadows at the ends of the reciprocal travel are significantly blurred. Thus this grid movement technique reduces the artifacts produced in the image by the radiographic grid lines.

DETAILED DESCRIPTION OF THE INVENTION

Figure 1:
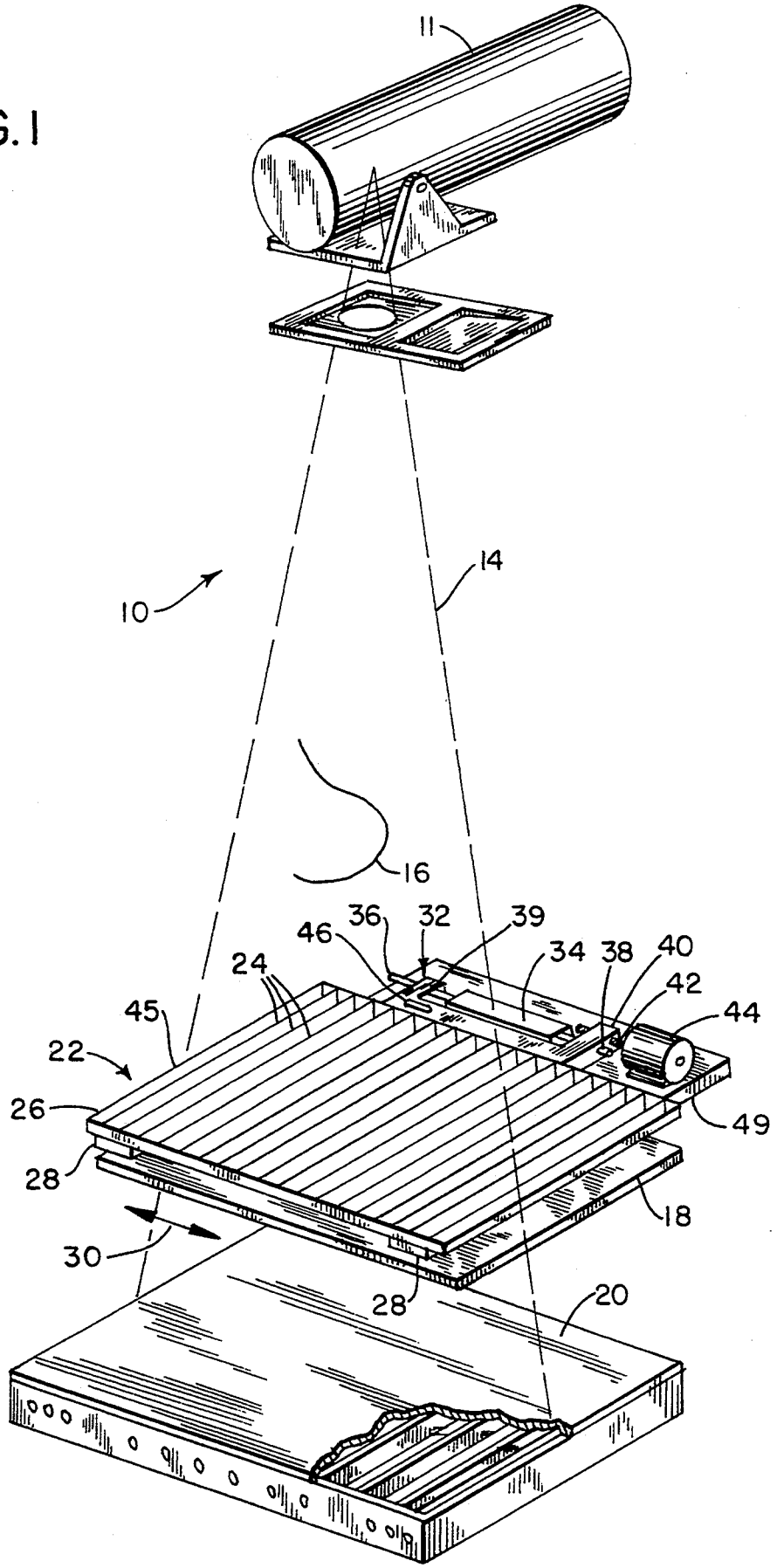
FIG. 1 is a simplified, exploded perspective view of an X-ray radiograph apparatus showing a grid mechanism according to the present invention.

Referring to FIG. 1, a radiographic system 10 includes an X-ray tube 11 directed to project a beam of X-rays 14 through soft tissue 16 toward a conventional X-ray sensitive medium 18. After passing through the medium 18, the X-rays are detected by an exposure detector 20, such as that described in U.S. Pat. No. 4,970,398 entitled "Focused Multi-Element Detector For X-Ray Exposure Control."

A radiographic grid assembly 22 is located between the soft tissue 16 being imaged and the medium 18 to block scattered X-rays. The grid assembly 22 is composed of a grid 26 formed by a series of spaced apart X-ray absorbing vanes 24 which are aligned or "focused" to the X-ray tube 11. The vanes 24 form channels of a given width and height which prevent scattered X-rays from reaching the medium 18.

One side of grid 26 rides on base members 28 which permit the grid to move in the reciprocal directions indicated by arrows 30. A U-shaped drive bracket 32 is attached to the opposite side of the grid 26 from members 28. A support 34 on fixed base 49 is positioned within the opening of the drive bracket 32 and has rods 36 and 38 extending outwardly therefrom through apertures in each leg of the bracket. The drive bracket 32 is able to slide on the rods 36 and 38 as the grid 26 reciprocates in the directions indicated by arrows 30.

One leg 40 of drive bracket 32 has a threaded aperture therethrough which receives a threaded shaft 42 of a bidirectional stepper motor 44 that is attached to base 49. As the stepper motor 44 drives shaft 42, the radiographic grid 26 moves in one of the directions indicated by arrows 30 depending upon the direction of rotation of that shaft. As is well-known, stepper motors provide a very accurate incremental movement of a shaft as will be described each time the motor is driven by a step signal.

The grid assembly contains a mercury tilt switch 46 which closes when the grid assembly 22 is tilted into vertical orientation as occurs when the X-ray apparatus 10 is swiveled orthogonally to the orientation shown in FIG. 1. The tilt switch 46 is positioned at an angle of approximately 20 degrees from horizontal in the orientation of the system 10 shown in FIG. 1. When the edge 45 of the grid 26 is above the motor 44 by a given amount, the tilt switch 46 closes, providing a signal to a control circuit for the motor, as will be described.

Figure 2:
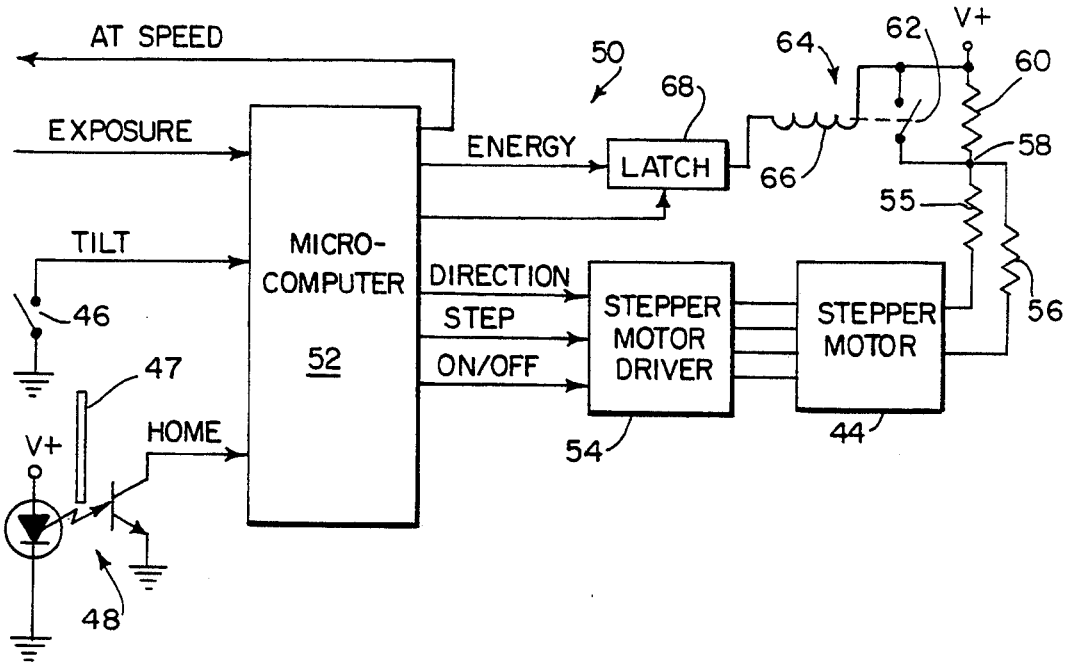
FIG. 2 is a block schematic diagram of the circuitry for controlling motion of the grid.

The grid assembly 22 also contains a electro-optic sensor 48 which produces a signal when the grid 26 is at either of the two extremes of its travel, known as "home positions." The electro-optic sensor 48 is mounted on base 49 of the grid assembly 22 and is a standard device having a light emitting diode and a phototransistor with a gap therebetween, as shown in FIG. 2. A shutter plate 47 is mounted on the grid 26 so as to pass between the diode and phototransistor of the electro-optic sensor 48 as the grid moves. The shutter plate 47 is shown schematically in FIG. 2 and is slightly shorter than the maximum travel of the grid 26. Thus, when the grid is at either end of its travel, the shutter plate 47 will clear the electro-optic sensor 48 allowing the diode to illuminate the phototransistor, which produces a signal designated HOME.

FIG. 2 depicts a control circuit 50 for operating the stepper motor 44. Control circuit 50 includes microcomputer 52 that contains a microprocessor, random access memory, read only memory and associated components. The program for controlling the operation of the grid assembly 22 is stored within the read only memory of the microcomputer 52. The microcomputer 52 receives an EXPOSURE signal via line 53 from a conventional main control system (not shown) of the radiographic system 10. This EXPOSURE signal goes to an active logic level when the main control system initiates an X-ray exposure and remains at the active logic level until the main control system determines that the X-ray exposure should be terminated.

The main control system for the radiographic apparatus 10 receives a signal designated AT SPEED from the microcomputer 52 indicating that the grid 26 has reached a normal operating speed. This signal may be produced a given interval of time after the microcomputer 52 begins activating the stepper motor 44. In another implementation of the present invention, the microcomputer 52 ramps up the speed of stepper motor 44, in which case the AT SPEED signal is produced when microcomputer 52 has ramped the stepper motor up to the full operating speed. The microcomputer 52 also receives the signal from tilt switch 46 and a HOME signal from the opto-sensor 48 which indicates when the grid 26 is in one of the home positions.

The microcomputer 52 responds to these input signals by producing a set of output signals which controls the direction and speed of the stepper motor 44. The application of power to the stepper motor 44 is governed by a conventional stepper motor driver 54. The microcomputer 52 produces an ON/OFF signal which activates the stepper motor driver 54. The direction in which the stepper motor 44 is to rotate shaft 42 is determined by a DIRECTION signal from the microcomputer 52 and each time that the stepper motor is to incrementally advance in that designated direction, the microcomputer sends a STEP signal pulse to the stepper motor driver 54. The stepper motor driver 54 responds to these signals from the microcomputer 52 by applying power to the appropriate coils of the stepper motor 44.

The common terminals for the coils of the stepper motor 44 are connected by resistors 55 and 56 to node 58. Another resistor 60 is connected to node 58 to form a voltage divider with resistors 55 and 56 between the stepper motor 44 and a source of positive voltage V+. A switch 62 of relay 64 is connected across resistor 60. When the relay switch 62 is in an open position, the voltage divider formed by resistors 55, 56 and 60 applies a relatively low voltage to the stepper motor 44. Whereas when the relay switch 62 is closed and resistor 60 is shorted, a higher voltage is applied to the stepper motor 44. The level of voltage applied to the stepper motor determines the energy and thus the force that is exerted by the stepper motor on the grid 26. As will be seen, the force will be varied in order to compensate for the gravitational effects on the grid 26.

Relay 64 is controlled by a digital ENERGY signal from the microcomputer 52. The logic level of the ENERGY signal is stored within a latch 68 which has an output that drives the coil 66 of relay 64.

The stepper motor 44 must move the grid 26 fast enough so that the grid vane pattern is sufficiently blurred to be indiscernible on the exposed radiograph. Since the grid vane pattern is uniformly repetitive, the minimum required velocity is inversely proportional to the spacing between the adjacent vanes of the grid. The greater the vane spacing, the faster the grid must move. This relationship is given by the mathematical expression $V_{min}=C/(T_{ex}\ S)$, where $V_{min}$ is the minimum threshold grid velocity, $T_{ex}$ is the exposure time, and S is the grid vane spacing. C is a proportionality constant that is dependent upon, among other things, characteristics of medium 18, film development processing and the specific X-ray apparatus employed. A value for C is derived from empirical test data for the specific configurations of the X-ray apparatus 10. The relationship of grid velocity to exposure time is plotted by the dashed line in FIG. 3. As can be seen, the shorter the exposure time, the greater the required velocity of the grid apparatus. Thus, to adequately blur the vane shadows, the stepper motor control circuit 50 must be capable of a velocity range which is sufficiently great to accommodate the entire range of possible exposure times.

In conventional radiographic systems, the duration of the exposure is controlled by a feedback loop in which detector 20 senses radiation flowing through the medium 18 and produces a signal indicative of the level of radiation. The detector signal is used by the main control system to determine when a proper exposure has occurred and when to shut off the X-ray tube 11. Therefore, at the commencement of a given X-ray exposure, the duration of that exposure is unknown. In order to accommodate this unknown exposure duration, the grid 26 is initially moved at a relatively high velocity which decreases over the exposure time as shown by the solid line in FIG. 3.

Figure 4A:
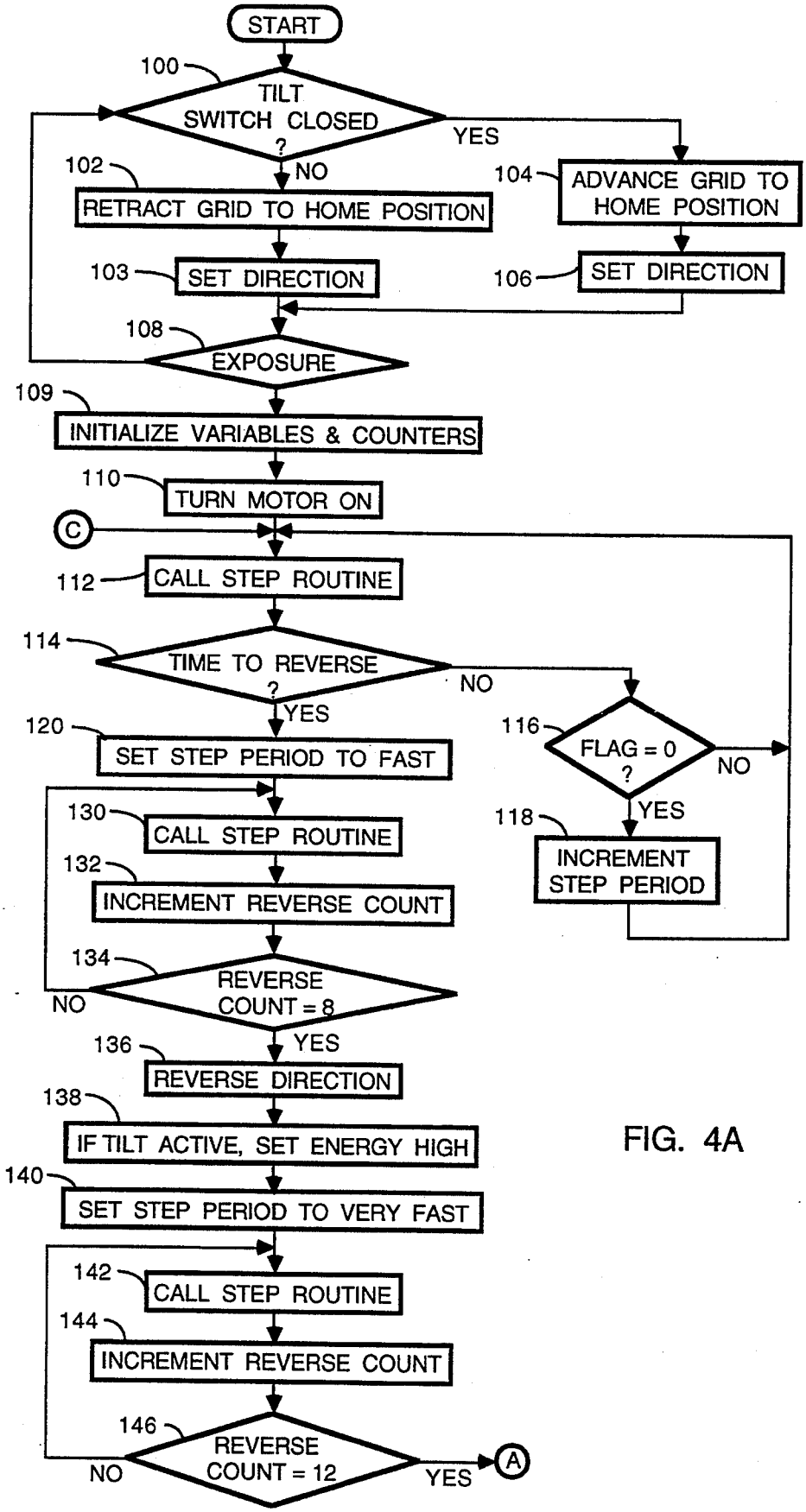
FIGS. 4A and 4B are flowcharts of the program executed by the circuitry in FIG. 2.

With reference to FIG. 4A, the speed of the grid 26 is determined by the control program which is executed by the microcomputer 52. The initial section of the program ensures that the grid is placed into the proper home position in expectation of an X-ray exposure. The orientation of the grid 26 at the start of an exposure is important as it is undesirable to initially move the grid upward against the force of gravity. Therefore, between X-ray exposures, the microcomputer 52 monitors the TILT signal to detect the orientation of the grid assembly 22.

The state of the tilt switch 46, as indicated by the logic level of the TILT signal, is checked at step 100 in order to sense the orientation of the grid assembly 22. If the tilt switch is not closed, the grid assembly is in either the horizontal position or an angular position with the motor above edge 45. In this case the home position to be used is toward the motor and the program execution advances to step 102. At that point the microcomputer activates the stepper motor driver 54 to retract the grid 26 into a home position. During retraction, the grid 26 moves toward the stepper motor 44 until the vane 47 on the grid clears the electro-optic sensor 48 so that the sensor produces an active HOME signal. Then at step 103, the microcomputer 52 reverses the DIRECTION signal for the stepper motor driver 54 to prepare for movement upon the start of an exposure. At this time the grid no longer moves, as STEP signal pulses are not being applied to the stepper motor driver 54.

If the tilt switch 46 is found closed at step 100, as occurs when the grid assembly 22 begins to be tilted vertically with edge 45 significantly above the stepper motor 44, the program branches to step 104. In this event, the grid 26 is advanced away from the stepper motor and into the home position at the opposite end of grid travel, where the electro-optic sensor 48 produces an active HOME signal. Thereafter, the DIRECTION signal is set at step 106 to produce movement of the grid 26 toward the stepper motor 44.

Once the grid is in the appropriate home position, the microcomputer 52 checks for an active EXPOSURE signal at program step 108. When this signal is inactive, the program execution returns to step 100 to monitor the tilt switch 46.

At the beginning of an X-ray exposure, the microcomputer 52 receives an active EXPOSURE signal on line 53 from the main X-ray system controller. This causes the program to advance to step 109 where variables and counters used in controlling the stepper motor 44 are initialized.

Figure 5:
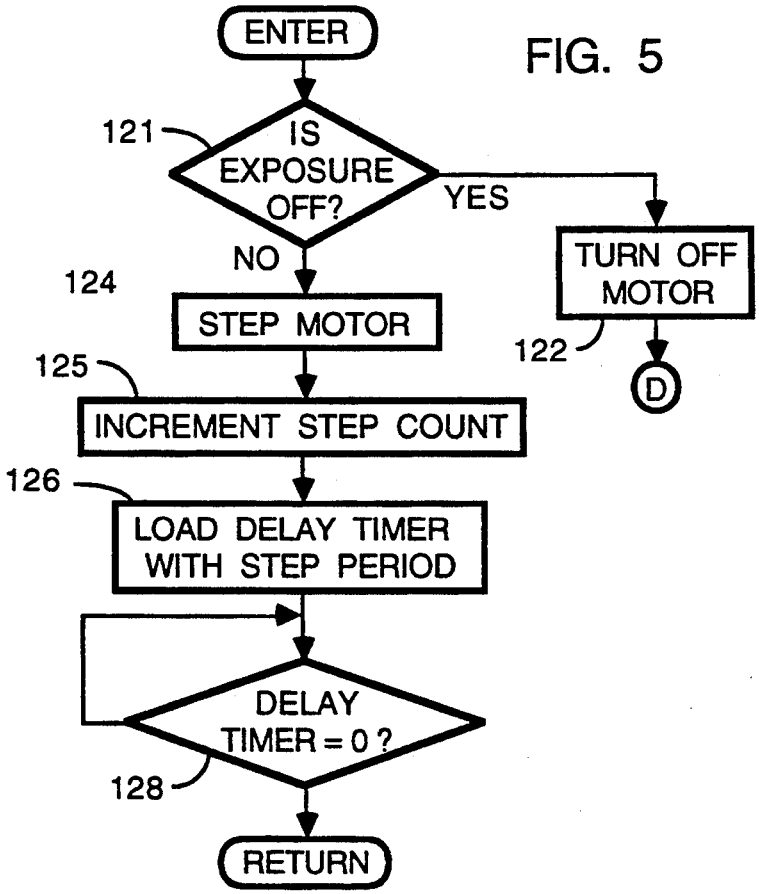
FIG. 5 depicts a flowchart of a subroutine called by the program in FIGS. 4A and 4B.

Then a "step" routine is called at program step 112 to produce incremental movement of the stepper motor 44. The step routine is shown in FIG. 5 and commences at program step 121 to check whether the main X-ray system computer is signalling that the exposure should continue, as indicated by an active EXPOSURE signal. Microcomputer 52 turns off the stepper motor 44 at step 122 if an exposure is not occurring, and the program returns to step 100. Otherwise during an exposure, the subroutine branches to step 124 where the microcomputer 52 produces a pulse of the STEP signal which causes the stepper motor driver 54 to move the stepper motor 44 one fixed increment in the direction indicated by the DIRECTION signal. A count of the steps during each movement cycle of the grid is maintained in the memory of microcomputer in order to know the position of the grid 26. At the commencement of the exposure, this count was zero and thereafter is incremented by one each time program step 125 is executed.

The rate of grid movement is determined by the interval of time between STEP signal pulses, the shorter the interval the faster the rate. The pulse interval is determined by a delay timer that is implemented as a conventional software routine executed by the microcomputer 52. This timer is loaded at step 126 with a delay period. At the beginning of the exposure (step 109), this delay period is set to a very short interval so as to produce maximum velocity of the grid as determined by the shortest allowable exposure time. As will be described, the delay period is incremented by a given amount in the early portion of the exposure so as to decrease the speed of the motor 44 and thus the grid 26 during the exposure time. Then at step 128, the delay timer is repeatedly inspected until it reaches zero, at which time the step routine terminates and returns to the point in the main program on FIG. 4A at which it was called.

Upon returning at this time, the program execution enters step 114 where the microcomputer 52 determines whether it is time to reverse the direction of the grid 26. Since each pulse of the STEP signal produces a fixed incremental movement of the stepper motor 44, the count of the step pulses indicates how far the grid 26 has moved. Thus, the number of pulses between the home position and the point of movement at which direction reversal should begin is known. Therefore, at step 114, that number of pulses is compared to the value in the step counter, called STEP COUNT. If the two values are not equal, the program execution advances to step 116. At this time, the microcomputer 52 checks a flag which during the initial stage of the grid movement (prior to point 61 on FIG. 3) has a zero value. This causes step 118 to be executed where the step period is incremented by a given amount to slow the grid speed, as shown by the solid line in FIG. 3. Once the step period has been incremented, the program execution returns to step 112 to once again call the step routine to incrementally advance the stepper motor 44 and thus the grid 26. This loop through program steps 112–118 continues until the STEP COUNT reaches a value which indicates that reversal of the grid 26 should begin.

Figure 3:
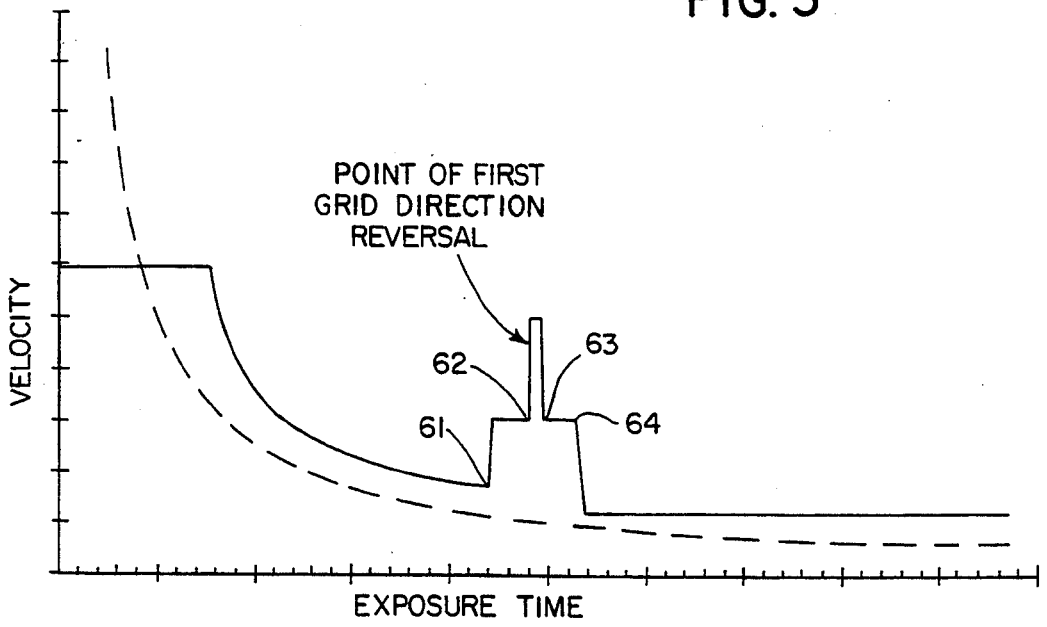
FIG. 3 is a graph of the absolute velocity of the grid versus exposure time.

Reversal of the grid 26 starts at point 61 in FIG. 3 when the grid is approaching the extreme end of its travel from the home position. Then, the program execution advances to step 120 where the step period is set to a much shorter fixed value designated as "FAST." This significantly shorter step period approximately doubles the grid velocity between points 61 and 62 as shown in FIG. 3. At program step 130, the step routine is called once again to produce movement of the stepper motor and grid at this faster speed. This action results in movement of the grid 26 at an increased speed near the ends of travel in order to prevent grid lines in the X-ray image due to dwell of the grid at the extreme points.

During the reversal procedure at the ends of grid travel, a separate count of movement steps is maintained in a memory location designated "reverse count." At step 132, the reverse count is incremented by one. Operation at the FAST speed continues for a number of motor steps, for example eight. During this time, the program repeatedly loops through steps 130–134. When eight steps at the FAST speed have occurred, program execution advances from step 134 to step 136.

It is now time to reverse the direction of the grid 25 and the microcomputer 52 changes the logic level of the DIRECTION signal at step 136. As noted previously, if the grid assembly 22 has been tilted significantly from the horizontal, higher energy must be applied to the stepper motor 44 when the grid 26 is travelling upward against the force of gravity. Thus, if the TILT signal is active, the ENERGY signal must be set at step 138 to indicate high energy is required due to reversal of the movement direction. The reversal of the grid direction occurs at time 62 in FIG. 3 and as illustrated, the initial operation in the reverse direction occurs at even a faster speed than was occurring prior to time 62. Thus, at program step 140, microcomputer 52 sets the step period to an even shorter value designated "VERY FAST." The fixed values for FAST and VERY FAST are stored in a data table within the internal ROM of the microcomputer.

Figure 4B:
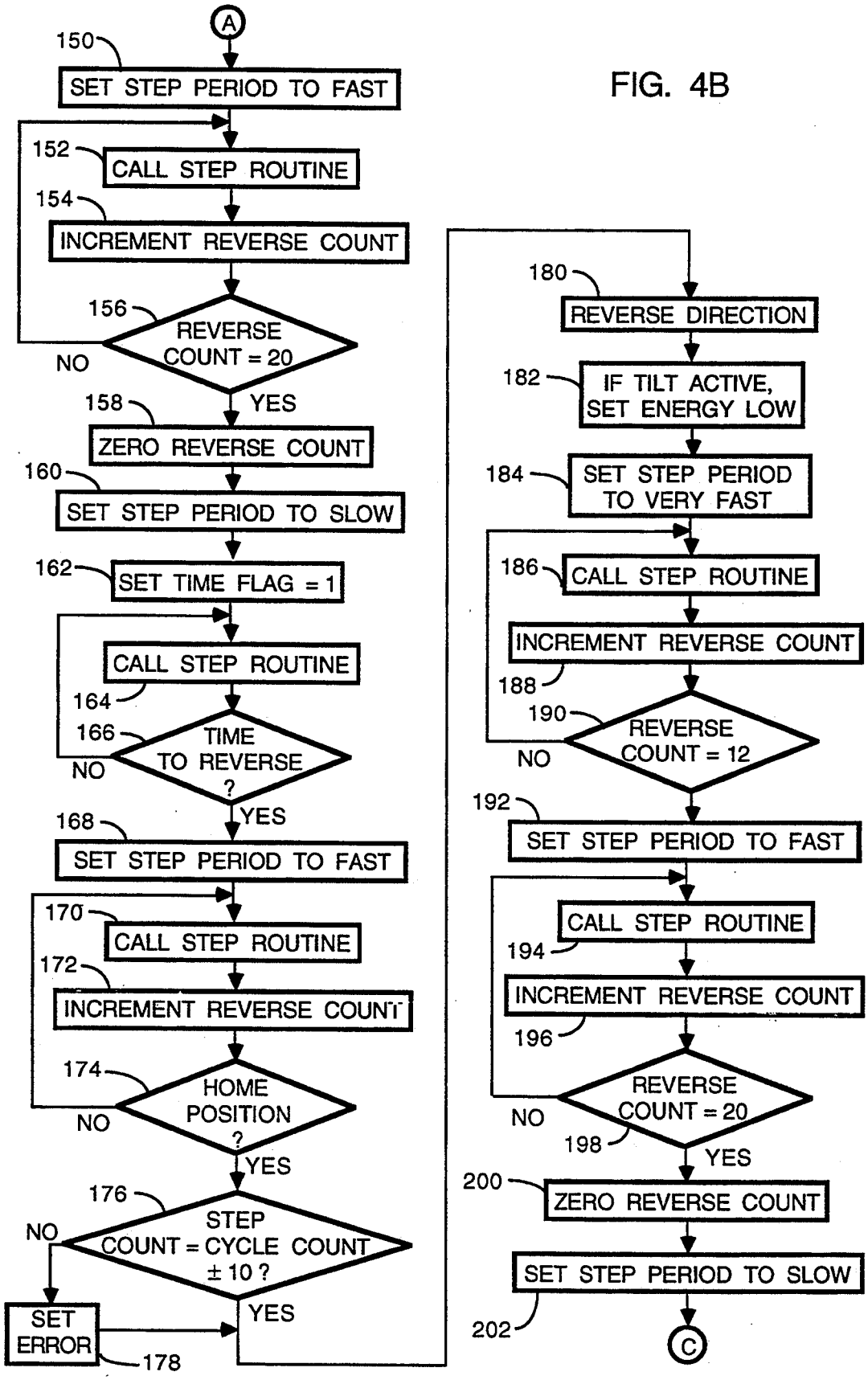

At steps 142 and 144, the step routine is called to produce an incremental movement of the grid 26 at this higher speed and the reverse count is incremented by one. The VERY FAST speed occurs for a relatively short period of time, for example four movement steps, which is sufficiently long to ensure blurring of the vanes 24 at the turn-around location. Thus, when the step count reaches a value of 12 at step 146, as occurs at time 63, the program execution advances to step 150 on FIG. 4B.

The step period is once again set to the FAST value to decrease the speed of the grid. Then at steps 152, 154 and 156, eight more steps at this intermediate speed occur as indicated between points 63 and 64 in FIG. 3. Time 64 occurs at the end of the reversal process, where the reverse count is zeroed at step 158 to prepare for the next reversal process. Then, grid speed is reduced dramatically by setting the step period to a relatively large value, designated SLOW, at step 160 to move the grid even slower than occurred immediately prior to the direction reversal at time 61. The speed maintained constant at this SLOW level by setting the flag to one at step 162 so that the step period will no longer be incremented at program step 118 as happens prior to time 61.

Movement at this fixed SLOW speed is accomplished by continuously calling the step routine at program step 164 until the step count indicates at step 166 that the direction of the grid should be reversed again as it is approaching the home position.

When the step count indicates that the grid is a fixed distance, for example eight steps, from the home position, the program execution advances to step 168 where the step period is once again set to the FAST value. The step routine is called at step 170 to advance the grid one increment of the stepper motor. Following the step routine, the reverse count is incremented and a determination is made at step 174 whether the grid has reached the home position as indicated by the HOME signal from the electro-optic sensor 48. The program execution continues looping through step 170-174 until the home position is reached.

Upon reaching the home position, microcomputer 52 acts as a comparator by comparing the STEP COUNT to a value designated CYCLE COUNT, which is the nominal number of movement steps which occur during a cycle of grid 26. If the actual STEP COUNT is not within a given tolerance, e.g. ±10, of the CYCLE COUNT, the microcomputer sets an error indicator at step 178.

In either event, the program execution then advances to step 180 to once again reverse the direction of the grid 26 by changing the logic level of the DIRECTION signal to the stepper motor driver 54. Then at step 82, if the TILT signal is active, the ENERGY signal is set to a low logic level to decrease the energy applied to the stepper motor 44 since the new direction of travel will be downward and not against the force of gravity.

Then the step period is set to the VERY FAST value at step 184 and steps 186, 188 and 190 produce four increments of movement at that very fast speed. Then the step period is set to the FAST value at step 192 and at steps 194, 196 and 198, eight steps, for example, occur at the fast speed. When those steps have been completed, the grid may once again travel at the slow speed. Therefore, the reverse count is zeroed at step 200 and the step period is set to the SLOW value at step 202. The program execution then returns to step 112 to begin another reciprocal cycle of the grid movement.

As can be seen from the graph of FIG. 3, the motor speed increases just before reversal of the grid direction. Immediately following the reversal, the grid is moved at an even higher speed for a short amount of time and then at an intermediate speed, before returning to a normal slow speed. This rapid movement of the grid before and after direction reversal, eliminates the shadows which previously occurred due to dwell of the grid at the points of reversal. Furthermore, the comparison of the actual number of movement steps to the nominal amount for a grid cycle provides an indication of when the grid is not moving satisfactorily.

We claim:

1. A diagnostic X-ray system for producing a radiographic image of a body on an X-ray sensitive medium comprising:

an source for producing a beam of X-ray radiation that is directed through the body and toward the X-ray sensitive medium;

a grid positioned within the beam between the body and the X-ray sensitive medium to reject X-rays that were scattered by the body;

a stepper motor attached to move said grid reciprocally in steps along a movement axis between a first end point and a second end point; and a mechanism for controlling said stepper motor to move said grid at a first rate of movement toward the first end point when said source commences emitting X-rays and thereafter periodically decreases the rate of movement, when said grid reaches a given distance from the first end point said mechanism increases movement of said grid to a second rate until said grid is at the first end point at which time said grid is reverses direction, and upon reversing direction said mechanism controls said stepper motor to move said grid at the second rate for a predetermined distance and thereafter decreases the rate of movement of said grid.

2. The diagnostic X-ray system as recited in claim 1 wherein immediately upon said grid reversing direction, said mechanism controls said stepper motor to produce movement of said grid at a third rate, that is greater than the second rate, for a predefined distance before moving said grid at the second rate of movement for a predetermined distance.

3. The diagnostic X-ray system as recited in claim 1 wherein said mechanism includes a counter to count steps of grid movement; and means connected to said counter for determining when said grid reaches the given distance, and has traveled the predetermined distance.

4. The diagnostic X-ray system as recited in claim 1 further comprising a counter coupled to said mechanism to count the steps that said grid moves; a comparator which compares a count of the steps to a reference value; and an indicator that produces an error signal in response to said comparator.

5. The diagnostic X-ray system as recited in claim 1 further comprising a detector which senses when said grid is tilted so that the movement axis is not horizontal; and another mechanism which responds to said detector by moving said grid to whichever one of the first end point and a second end point is higher.

6. The diagnostic X-ray system as recited in claim 1 further comprising a sensor which produces a signal when said grid is located at one of the first and second end points with the signal being applied to said mechanism for controlling the stepper motor.

7. A method of moving a radiographic grid of an X-ray imaging system reciprocally between two end points along a linear axis, steps of said method comprising:

upon commencement of an X-ray exposure, moving the grid at a first rate of movement in a direction toward one end point;

then periodically decreasing the rate of movement until the grid reaches a given distance from the one end point;

when the grid reaches a given distance from the one end point, increasing movement of the grid to a second rate;

when the grid reaches the one end point, reversing movement of the grid to second direction toward the other end point;

moving the grid in the second direction at a third rate of movement for a predefined distance wherein said third rate of movement is faster than the rate of movement at the given distance; and thereafter, decreasing the rate of movement.

8. The method as recited in claim 7 further comprising immediately after reversing movement of the grid, moving the grid in the second direction at a fourth rate for a given distance before movement occurs at the third rate, the fourth rate being greater the both the second rate and the third rate.

9. The method as recited in claim 7 wherein the second rate and the third rate are equal.

10. The method as recited in claim 7 further comprising prior to commencement of the exposure moving the grid near an end point so that movement of the grid at the first rate will not be against the force of gravity.

11. The method as recited in claim 7 wherein movement of the grid occurs in incremental steps of identical length with a period of time between each step being different for each of the first, second and third rates.

12. The method as recited in claim 11 further comprising counting each step to determine when to make a transition between rates of movement.

13. The method as recited in claim 11 further comprising counting each step and comparing a count of steps to a reference value to evaluate performance of grid movement.

* * * * *